US010562322B2

(12) United States Patent
Quarto et al.

(10) Patent No.: US 10,562,322 B2
(45) Date of Patent: Feb. 18, 2020

(54) PRINT MEDIUM GUIDES

(71) Applicant: HEWLETT-PACKARD DEVELOPMENT COMPANY, L.P., Houston, TX (US)

(72) Inventors: Daniel E. Quarto, Vancouver, WA (US); Devin Knowles, Vancouver, WA (US); Kevin Witkoe, Vancouver, WA (US); Victor Bruhn, Vancouver, WA (US); Teressa L. Roth, Vancouver, WA (US)

(73) Assignee: Hewlett-Packard Development Company, L.P., Spring X ( * ) Notice: Subject to any disclaimer, the term of this patent is extended or adjusted under 35 U.S.C. 154(b) by 70 days.

(21) Appl. No.: 15/835,410

(22) Filed: Dec. 7, 2017

(65) Prior Publication Data

US 2019/0176492 A1 Jun. 13, 2019

(51) Int. Cl.

| | |
|---|---|
| ***B41J 11/00*** | (2006.01) |
| ***B41J 13/10*** | (2006.01) |
| ***B41F 21/04*** | (2006.01) |

(52) U.S. Cl.

CPC ..... *B41J 11/006* (2013.01); *B41F 21/04* (2013.01)

(58) Field of Classification Search

CPC ... B41J 11/006; B41J 13/103; G03G 15/6529; G03G 15/6555; B65H 2511/528

See application file for complete search history.

(56) References Cited

U.S. PATENT DOCUMENTS

| | | | | |
|---|---|---|---|---|
| 5,974,290 | A * | 10/1999 | Inoue | G03G 21/1638 271/301 |
| 7,346,294 | B2 | 3/2008 | Lee | |
| 7,784,928 | B2 | 8/2010 | Okamoto | |
| 8,360,425 | B2 | 1/2013 | Chng et al. | |
| 8,696,107 | B2 | 4/2014 | Lo et al. | |
| 2008/0205914 | A1 | 8/2008 | Jeon | |
| 2013/0084119 | A1* | 4/2013 | Iijima | B65H 29/58 400/611 |

FOREIGN PATENT DOCUMENTS

| | | | |
|---|---|---|---|
| JP | 63246755 | A * | 10/1988 |
| JP | 2005324535 | A | 11/2005 |

* cited by examiner

*Primary Examiner* — Leslie J Evanisko
(74) *Attorney, Agent, or Firm* — Rahman LLC

(57) ABSTRACT

An example assembly includes a first guide positioned in a pre-print zone area of an imaging device. A second guide rotatably is connected to the imaging device and spaced apart from the first guide to permit a print medium to traverse between the first guide and the second guide. A bearing mechanism connects the second guide to the imaging device in the pre-print zone area. An interface mechanism is operatively connected to the second guide. A bias element is positioned between the interface mechanism and the second guide to release energy upon exposing the interface mechanism to the pre-print zone area allowing rotation of the second guide away from the first guide.

12 Claims, 11 Drawing Sheets

PRINT MEDIUM GUIDES

BACKGROUND

An imaging device contains internal paths for directing print media through the device. The imaging device, which may be a multifunction copier, scanner, or printer may use the print media to produce copies, scan from, or print to, etc. The imaging device may output the print media once it has processed it.

DETAILED DESCRIPTION

Figure 1:
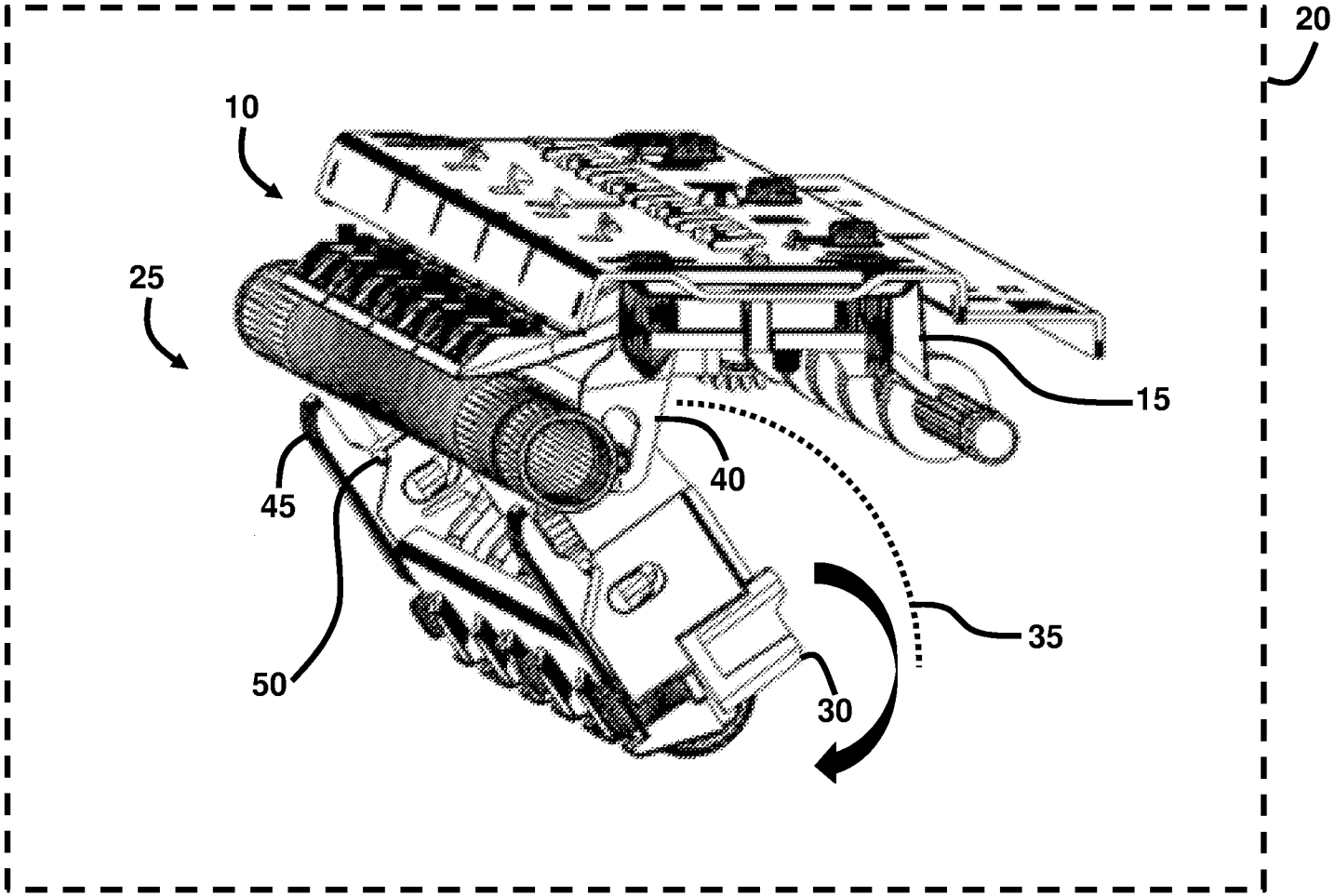
FIG. 1 is a schematic diagram illustrating an assembly to clear a print medium jam in an imaging device, according to an example.

As referred to herein, the term printable or print medium or media may refer to one or more sheets of paper or any other media suitable for insertion into an imaging device. The print medium may be any type of print medium including paper, photopolymers, thermopolymers, plastics, composite, metal, wood, etc., and may include any suitable feature including the size, shape, material, thickness, or any other quality suitable for placement in the imaging device. A paper guide assembly is provided with a passive jam clearance feature.

In some examples, the print media may become jammed inside the imaging device. Removing the jammed print media from the device is often necessary in order for the device to function properly and for the print, copy, or scan job, etc. to be performed, and for the next job to be processed. The jammed media may be difficult to access for removal.

In order to address the above, the examples described herein provide a print medium guide assembly to include a lower guide that rotates about hinges to open up the pre-print zone area or paper path, and an upper guide that buffers the area where the paper jam may be occurring. The lower guide is rotatable rather than being completely fixed. The paper path opens when a support mechanism is removed, and jammed paper may fall into an easily accessible area for retrieval by a user. The assembly further includes one or more lever or ramp mechanisms that interfaces with a support mechanism such that the support mechanism contacts the assembly by way of the lever or ramp mechanism(s), and when the support mechanism is removed, there is no longer a structure to retain the assembly in its closed position, which allows the lower guide to rotate downward and open up and release the jammed paper.

An example provides an assembly comprising a first guide positioned in a pre-print zone area of an imaging device; a second guide rotatably connected to the imaging device and spaced apart from the first guide to permit a print medium to traverse between the first guide and the second guide; a bearing mechanism connecting the second guide to the imaging device in the pre-print zone area; an interface mechanism operatively connected to the second guide; and a bias element positioned between the interface mechanism and the second guide to release energy upon exposing the interface mechanism to the pre-print zone area allowing rotation of the second guide away from the first guide. The second guide may be rotatable due to gravitational effects upon the second guide. The bias element may release energy upon removal of a support mechanism positioned against the interface mechanism. The rotation of the second guide away from the first guide may create a space between the first guide and the second guide that releases the print medium from between the first guide and the second guide. The interface mechanism may be rotatably connected to the second guide.

Another example provides a device comprising a print medium guide held in a first position in a printer to permit a print medium to traverse along a pre-print zone print medium path; a first mechanism rotatably connecting the print medium guide to the printer; a second mechanism operatively connected to the print medium guide; and a spring biasing the second mechanism against the print medium guide to cause the second mechanism to pivot upon release of potential energy stored in the spring allowing rotation of the print medium guide into a second position and creating an open area in the pre-print zone print medium path. The first mechanism may comprise a pair of hinges. The second mechanism may comprise a pair of levers. The potential energy may be released from the spring upon removal of a support mechanism from against the second mechanism. The device may comprise a fixed guide connected to the printer, positioned in a pre-print zone area of the printer, and spaced apart from the print medium guide in both the first position and the second position. The print medium guide may be substantially parallel to the fixed guide in the first position. The print medium guide may be substantially perpendicular to the fixed guide in the second position.

Another example provides a machine-readable storage medium comprising instructions that when executed cause a processor of an electronic device to detect a print medium on a pre-print zone path of the electronic device; instruct the electronic device to transport the print medium adjacent to a print medium rotation guide held in a first position and rotatably connected to the electronic device; detect a print medium jam with respect to an area of the pre-print zone path adjacent to the print medium rotation guide; transmit instructions to remove a support mechanism from the pre-print zone path; and detect removal of the support mechanism. The processor may detect a releasing of a bias element that retains the print medium rotation guide in the first position and the rotation of the print medium rotation guide into the second position. The processor may detect a releasing of the print medium from the pre-print zone path upon the print medium rotation guide moving back into the first position.

FIG. 1 illustrates an assembly 10 comprising a first guide 15 positioned in a pre-print zone area 25 of an imaging device 20; a second guide 30 rotatably connected to the imaging device 20 and spaced apart from the first guide 15 to permit a print medium 35 to traverse between the first guide 15 and the second guide 30; a bearing mechanism 40 connecting the second guide 30 to the imaging device 20 in the pre-print zone area 25; an interface mechanism 45 operatively connected to the second guide 30; and a bias element 50 positioned between the interface mechanism 45 and the second guide 30 to release energy upon exposing the interface mechanism 45 to the pre-print zone area 25 allowing rotation of the second guide 30 away from the first guide 15. In an example, the pre-print zone area 25 is that area of the imaging device 20 where the print medium 35 travels prior to entering the scan/copy/print zone that processes the print medium 35. In other words, the pre-print zone area 25 is the area in the imaging device 20 prior to the print medium 35 being scanned, copied, printed, etc. According to an example, the bearing mechanism 40 may be a structural mechanism that permits the second guide 30 to rotate or articulate with respect to the first guide 15. The bearing mechanism 40 may also move with respect to the second guide 30 to permit the second guide 30 to move. The interface mechanism 45, according to an example, may be a structural mechanism that is positioned adjacent to the second guide 30; e.g., interfaces with the second guide 30. The interface mechanism 45 may be rotatable with respect to the second guide 30 and may be used to receive support forces to retain the second guide 30 in a closed position. In an example, the bias element 50 may be a structural component that stores and releases energy with respect to the interface mechanism 45. The bias element 50 may be held against and between the second guide 30 and the interface mechanism 45; e.g., biased against and between the second guide 30 and the interface mechanism 45.

Figure 2:
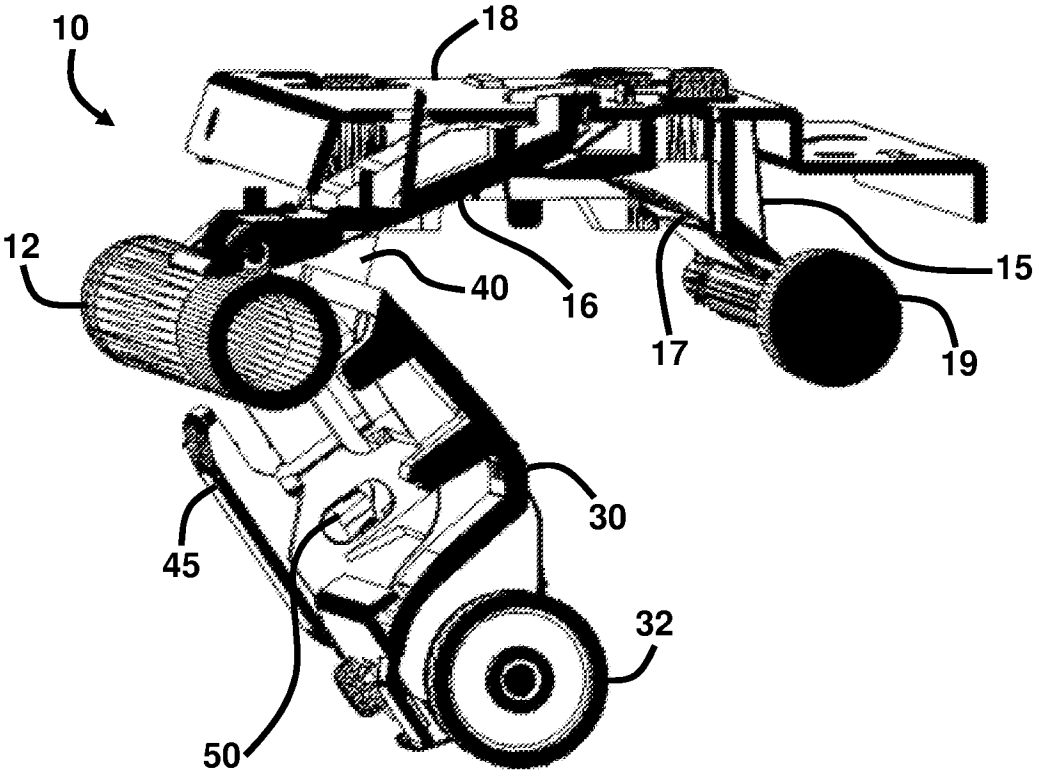
FIG. 2 is a sectional view of the assembly of FIG. 1, according to an example.

FIG. 2, with reference to FIG. 1, illustrates a cross-sectional view of the assembly 10. In an example, the first guide 15 is a fixed guide that is affixed to a backplate 18. The second guide 30 is rotatable with respect to the backplate 18, and thus the second guide 30 is also rotatable with respect to the first guide 15 since the first guide 15 is held in a fixed position with respect to the backplate 18. More particularly, the second guide 30 may rotate freely about the bearing mechanism 40, which may be a hinge according to an example. The first guide 15 comprises an upper paper guide component 16 and an outer paper guide component 17, which collectively form the first guide 15. The interface mechanism 45 may be a lever or ramp-like mechanism, according to an example, with the bias element 50, which may be a spring in an example, positioned inside the interface mechanism 45 and positioned against; i.e., biased against, the second guide 30. Accordingly, when the interface mechanism 45 is pressed against the second guide 30, the bias element 50 may begin to bias against the second guide 30 with increased potential energy being generated in the bias element 50. For example, if the bias element 50 is a spring, then when the interface mechanism 45 is pressed against the second guide 30, the bias element 50; i.e., spring, begins to compress, which increases the potential energy stored in the bias element 50. When a force is removed from the interface mechanism 45, the bias element 50 releases its energy causing the interface mechanism 45 to rotate away from the second guide 30. The first guide 15 further includes one or more turn rollers 19, in an example, although in the view in FIG. 2 only one turn roller 19 is shown. Additionally, the second guide 30 further includes a feedshaft 12 and a plurality of turn rollers 32, although in the view in FIG. 2 only one turn roller 32 is shown.

Figure 3:
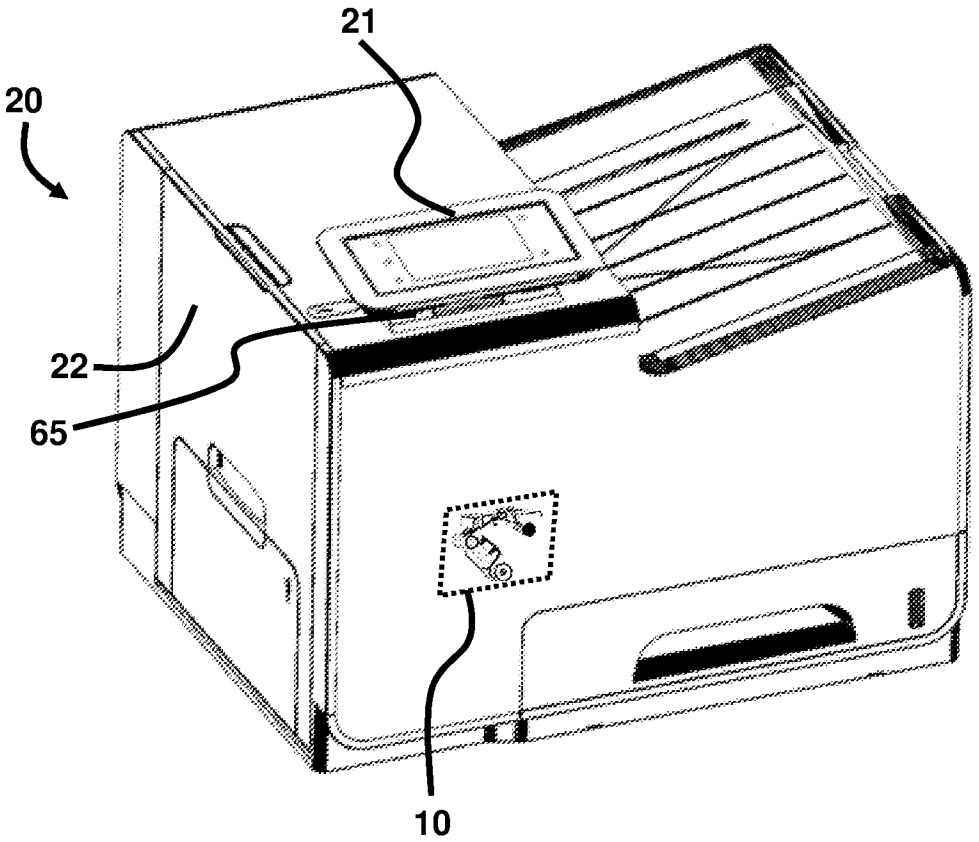
FIG. 3 is a perspective view of an imaging device containing the assembly of FIG. 1, according to an example.

FIG. 3, with reference to FIGS. 1 and 2, illustrates an example imaging device 20, which may contain the assembly 10. In an example, the imaging device 20 may be a hardware device, such as a printer, multifunction printer, copier, scanner, fax machine, or any other device with functionalities to physically produce representation(s) such as text, images, models, etc. on the print medium 35. In an example, the imaging device 20 may comprise a control panel 21 providing instructions and/or graphical representations of the assembly 10 to a user. The control panel 21 may be communicatively coupled to a processor 65, according to an example. Additionally, the imaging device 20 may comprise one or more access panels 22 that open to permit access to the interior of the imaging device 20. When a print medium jam occurs inside the imagine device 20, a user may open one or more of the access panels 22 to attempt to clear the jam. In an example, the assembly 10 may permit an automatic jam removal to allow a user to only have to retrieve the released jammed print medium 35 by reaching into the one or more access panels 22 without necessarily having to attempt to pry the print medium 35 from the assembly 10 or from between the first guide 15 and the second guide 30 or from between any of the turn rollers 19, 32 or from the feedshaft 12.

Figure 4:
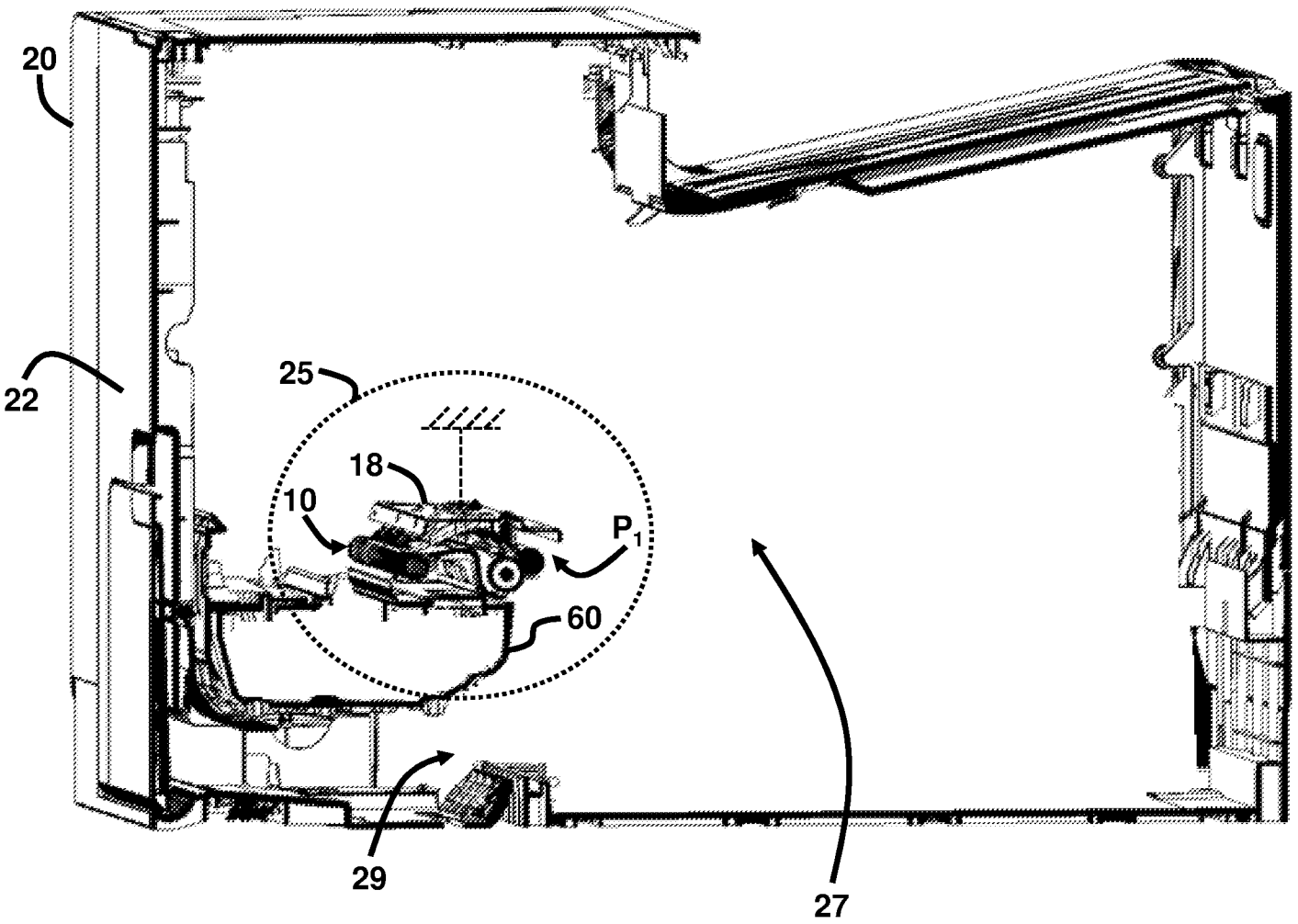
FIG. 4 is a sectional view of the imaging device of FIG. 3 containing the assembly of FIG. 1, according to an example.

FIG. 4, with reference to FIGS. 1 through 3, illustrates the interior 27 of the imaging device 20. The backplate 18 is an internal component of the imaging device 20 and is affixed to the imaging device 20 either directly or indirectly, according to an example. The assembly 10 is positioned in a pre-print zone area 25 of the imaging device 20. The pre-print zone area 25 may be positioned in any suitable area of an imaging device 20 prior to where the printing, scanning, or copying occurs, and such the position may vary depending on the style and/or size of the imaging device 20. Accordingly, the pre-print zone area 25 and positioning of the assembly 10 depicted in FIG. 4 is only an example. Again, the pre-print zone area 25 may constitute that area of the imaging device 20 where the print medium 35 travels and prior to being printed, copied, or scanned.

The second guide 30 is rotatably connected to the interior 27 of the imaging device 20 through the connection to the baseplate 18. The spacing between the first guide 15 and the second guide 30 is sufficient to permit a print medium 35 to traverse between the first guide 15 and the second guide 30. A support mechanism 60 is positioned adjacent to the assembly 10 to retain the second guide 30 in a closed position as shown in FIG. 4. The support mechanism 60 may be removable from the imaging device 20 such that a user may open the access panel 22 and pull the support mechanism 60 out of the imaging device 20. In an example, the support mechanism 60 may be a structural component in the imaging device 20 that is removable and which is positioned underneath the assembly 10 to hold the second guide 30 in the closed position. The support mechanism 60 may be made of any suitable material and may be a single continuous structure or may contain sub-components.

Figure 5:
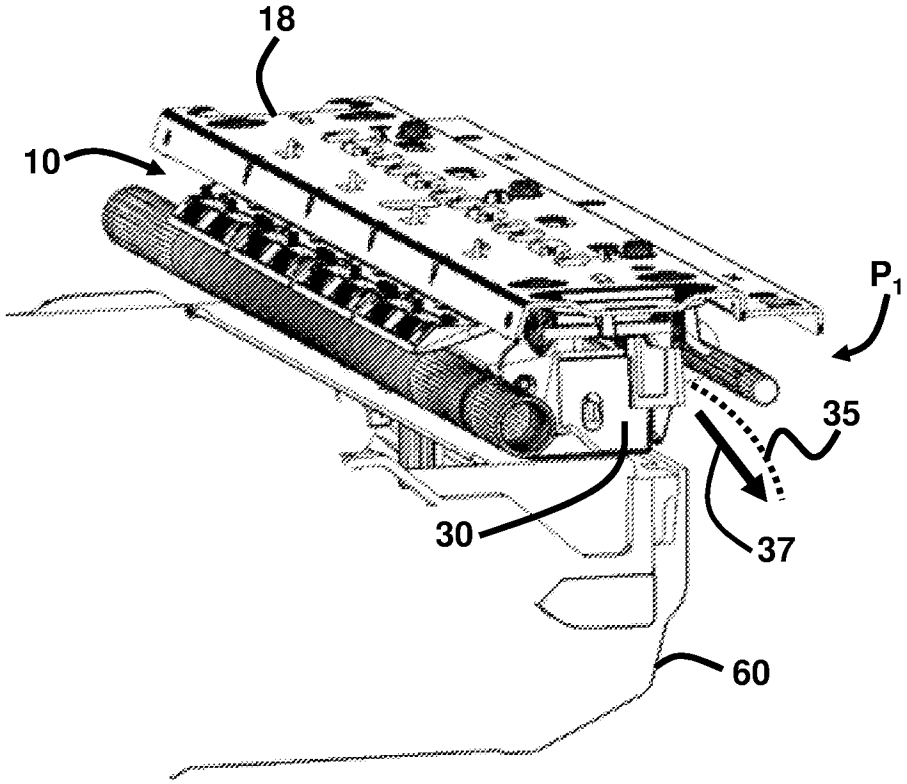
FIG. 5 is a perspective view of the assembly of FIG. 1 held in a first position by a support mechanism, according to an example.

FIG. 5, with reference to FIGS. 1 through 4, illustrates an isolated view of the assembly 10 and the support mechanism 60. The second guide 30, which may be referred to herein as a print medium guide 30, is held in a first position $P_1$ in the imaging device 20 to permit a print medium 35 to traverse along a pre-print zone print medium path 37. The first position $P_1$ of the assembly 10 occurs when the support mechanism 60 is inserted in the imaging device 20 and is held adjacent to the assembly 10 such that the support mechanism 60 supports or holds the second guide 30 in its closed configuration; i.e., the first position $P_1$. The support mechanism 60 may engage the second guide 30 by pressing against the interface mechanism 45, which further causes the bias element 50 to store potential energy.

Figure 6B:
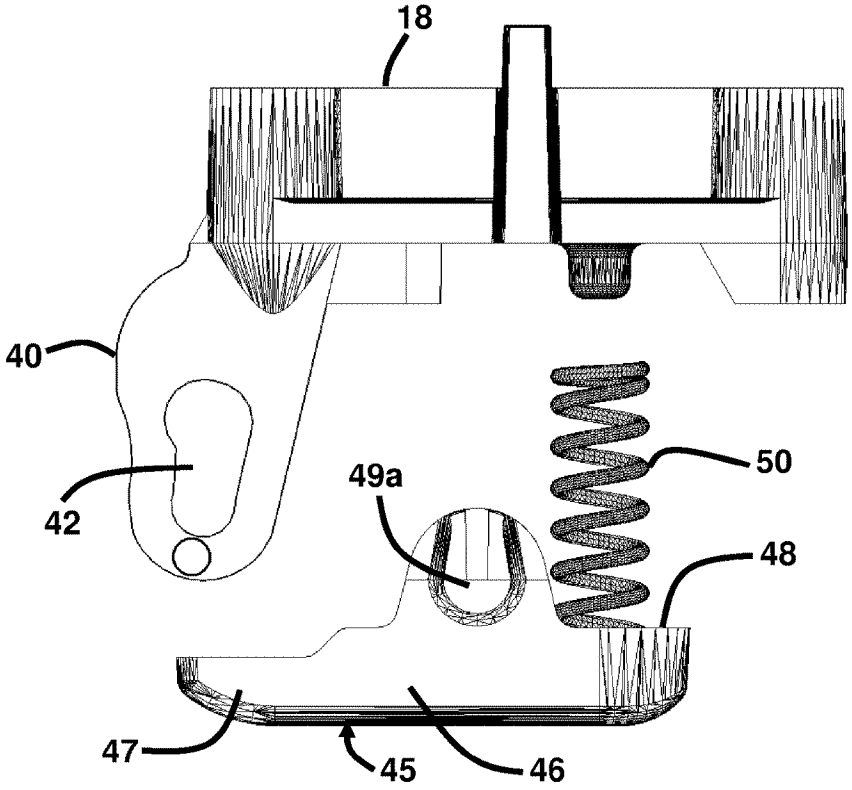
FIG. 6B is an isolated view of a bearing mechanism, interface mechanism, and bias element, according to an example.
Figure 6A:
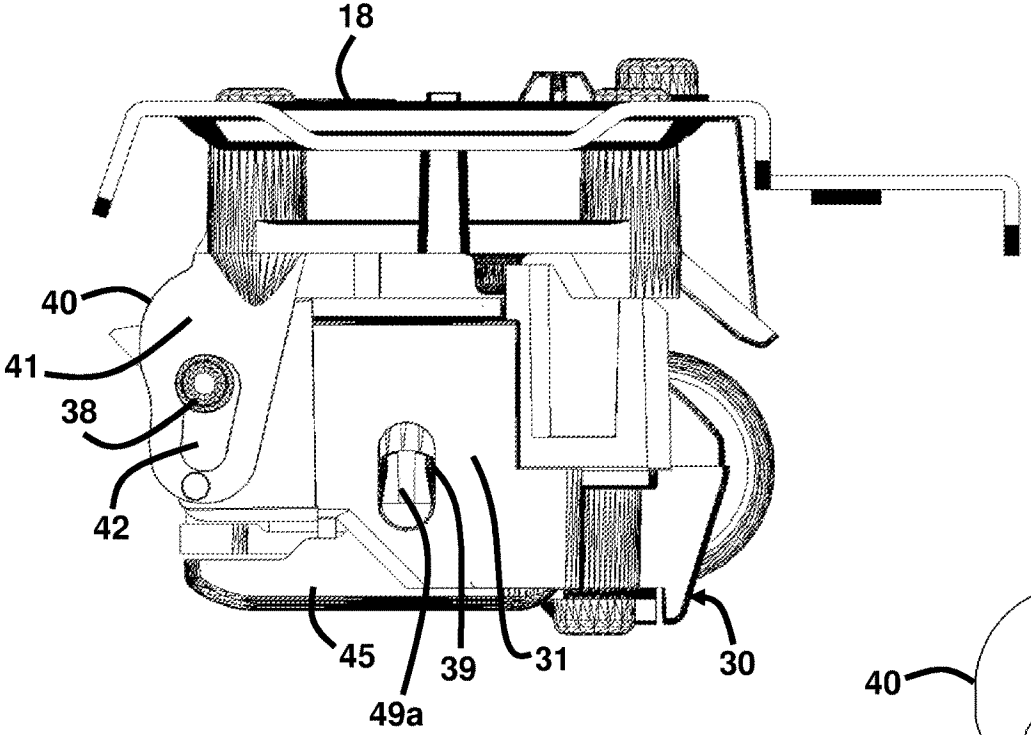
FIG. 6A is a side view of a second guide in the first position, according to an example.
Figure 6C:
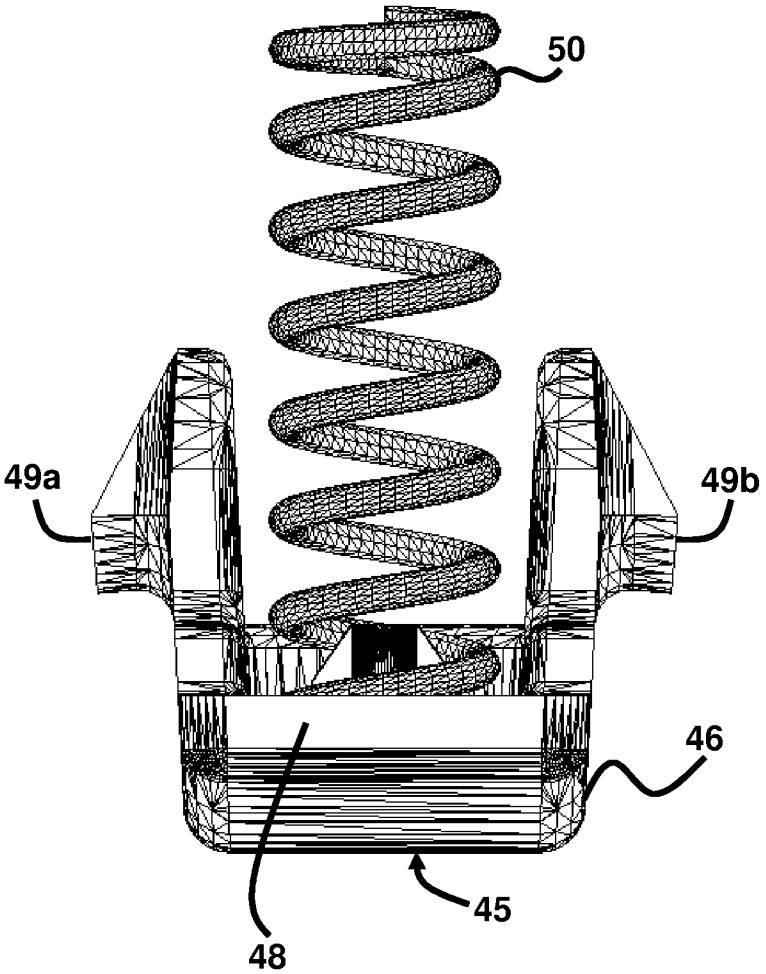
FIG. 6C is an isolated view of the interface mechanism and bias element, according to an example.

FIG. 6A, with reference to FIGS. 1 through 5, illustrates a side view of the second guide 30 in the first position $P_1$, according to an example. The bearing mechanism 40 is shown connecting the second guide 30 to the backplate 18. Since the backplate 18 is operatively connected to the imaging device 20, which is not shown in FIG. 6A, this allows the second guide 30 to operatively connect to the imaging device 20, and more particularly, allows the second guide 30 to be rotatably connected to the imaging device 20. In one example, the bearing mechanism 40 comprises a substantially elongated body component 41 with a hole 42. The bearing mechanism 40 is fixably attached to the backplate 18 according to one example. The second guide 30 comprises a pin 38, which is set to fit through the hole 42 to allow the bearing mechanism 40 to rotate with respect to the second guide 30. The hole 42 may be elongated to allow the second guide 30 to rotate from the first position $P_1$ to the second position $P_2$. The second guide 30 may also include a hole 39 on each lateral end 31 of the second guide 30. FIG. 6B, with reference to FIGS. 1 through 6A, is an isolated view of the bearing mechanism 40, interface mechanism 45, and bias element 50, according to an example with the second guide 30 removed in this view for ease of illustration. In an example, the interface mechanism 45 comprises a substantially elongated body 46 comprising a free end 47 and a distally positioned biased end 48. As further shown in FIG. 6C, with reference to FIGS. 1 through 6B, the interface mechanism 45 may also include a pair of catches 49*a*, 49*b*, with one catch 49*a* or 49*b* positioned on each side of the substantially elongated body 46. The bias element 50 may be positioned adjacent to the biased end 48 of the interface mechanism 45. The catch 49*a* is set to fit through the hole 39 of the second guide 30, as shown in FIG. 6A. The second guide 30 may include another hole, not shown, to permit the catch 49*b* to fit through that hole. The pair of catches 49*a*, 49*b* permit the interface mechanism 45 to slightly rotate with respect to the second guide 30.

Figure 7:
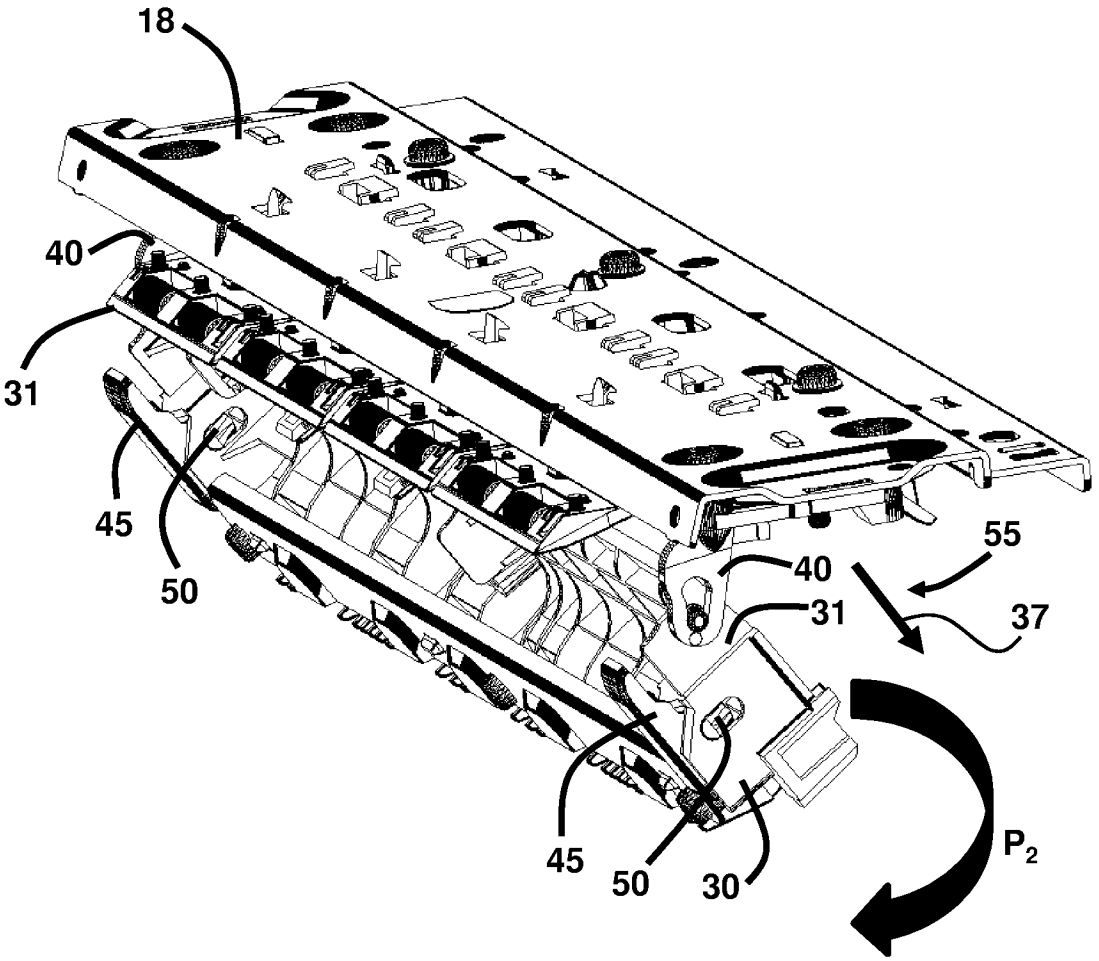
FIG. 7 is a perspective view of the assembly of FIG. 1 rotated into a second position with an open space created along a print medium path, according to an example.

As described above, the bearing mechanism 40, which may be referred to herein as a first mechanism 40, rotatably connects the second guide 30 to the interior 27 of the imaging device 20 in the pre-print zone area 25. In the example shown in FIG. 7, with reference to FIGS. 1 through 6C, the first mechanism 40 may comprise a pair of hinges positioned at each lateral end 31 of the second guide 30. As described above, the second mechanism 45, which may be referred to herein as an interface mechanism 45, is operatively connected to the second guide 30. In an example, the second mechanism 45 may be rotatably connected to the second guide 30. In another example, the second mechanism 45 may comprise a pair of levers or ramp-like mechanisms 45 positioned at each lateral end 31 of the second guide 30. In an example, the first mechanism 40 and second mechanism 45 are not connected to one another.

Figure 8:
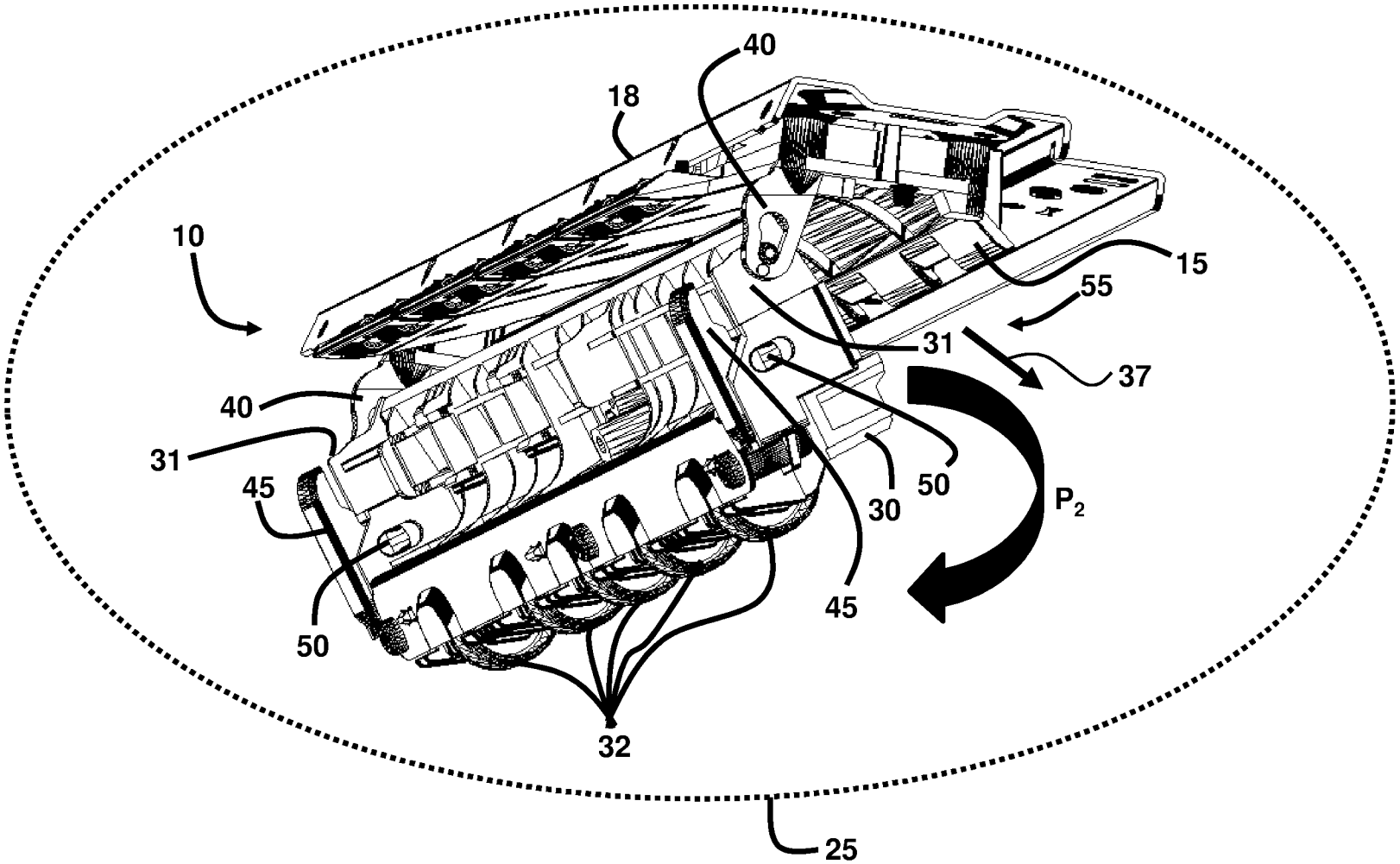
FIG. 8 is another perspective view of the assembly of FIG. 7 rotated into a second position with an open space created to clear a print medium jam, according to an example.

As further shown in FIG. 8, with reference to FIGS. 1 through 7, the bias element 50, such as a spring, is positioned between the interface mechanism 45 and the second guide 30 to release energy upon exposing the interface mechanism 45 to the pre-print zone area 25 allowing rotation of the second guide 30 away from the first guide 15. A pair of bias elements 50 may be provided with one bias element 50 positioned inside each interface mechanism 45 at each lateral end 31 of the second guide 30. The bias element 50 and the interface mechanism 45 exert a force between the second guide 30 and the support mechanism 60. When the support mechanism 60 is removed, the force is removed accordingly allowing rotation of the second guide 30 into a second position $P_2$ and creating an open area or space 55 in the pre-print zone print medium path 37. FIG. 8 further illustrates the plurality of turn rollers 32 connected to the second guide 30.

As such, the second guide 30 may be rotatable due to gravitational effects upon the second guide 30. In this regard, according to an example, when the support mechanism 60 is removed and no longer holds the second guide 30 in the first position $P_1$, then the second guide 30 is able to freely rotate into the second position $P_2$ such that the rotation is caused by the second guide 30 rotating downward as a result of gravity being exerted on the second guide 30. In another example, the bias element 50 may release energy upon removal of a support mechanism 60 positioned against the interface mechanism 45 which further causes the second guide 30 to rotate into the second position $P_2$. As such, the potential energy may be released from the bias element 50 upon removal of a support mechanism 60 from against the interface mechanism 45. The rotation of the second guide 30 away from the first guide 15 may create the space 55 between the first guide 15 and the second guide 30 that releases the print medium 35 from between the first guide 15 and the second guide 30.

As described above, the first guide 15 is a fixed guide connected to the imaging device 20, either directly or indirectly, and the first guide 15 is positioned in the pre-print zone area 25 of the imaging device 20. Moreover, the first guide 15 is sufficiently spaced apart from the second guide 30 in both the first position $P_1$ and the second position $P_2$. However, the spacing between the first guide 15 and the second guide 30 in the first position $P_1$ is closer than the spacing between the first guide 15 and the second guide 30 in the second position $P_2$. It is in the first position $P_1$ where the print medium 35 may become jammed as it traverses through the pre-print zone print medium path 37, and once the second guide 30 rotates into the second position $P_2$ the print medium 35 may be freely released due to the space 55 created between the first guide 15 and the second guide 30. In both the first position $P_1$ and the second position $P_2$, the first guide 15 remains in a stable or fixed position affixed to the backplate 18. According to an example, the second guide 30 may be substantially parallel to the first guide 15 in the first position $P_1$, and the second guide 30 may be substantially perpendicular to the first guide 15 in the second position $P_2$.

Figure 9:
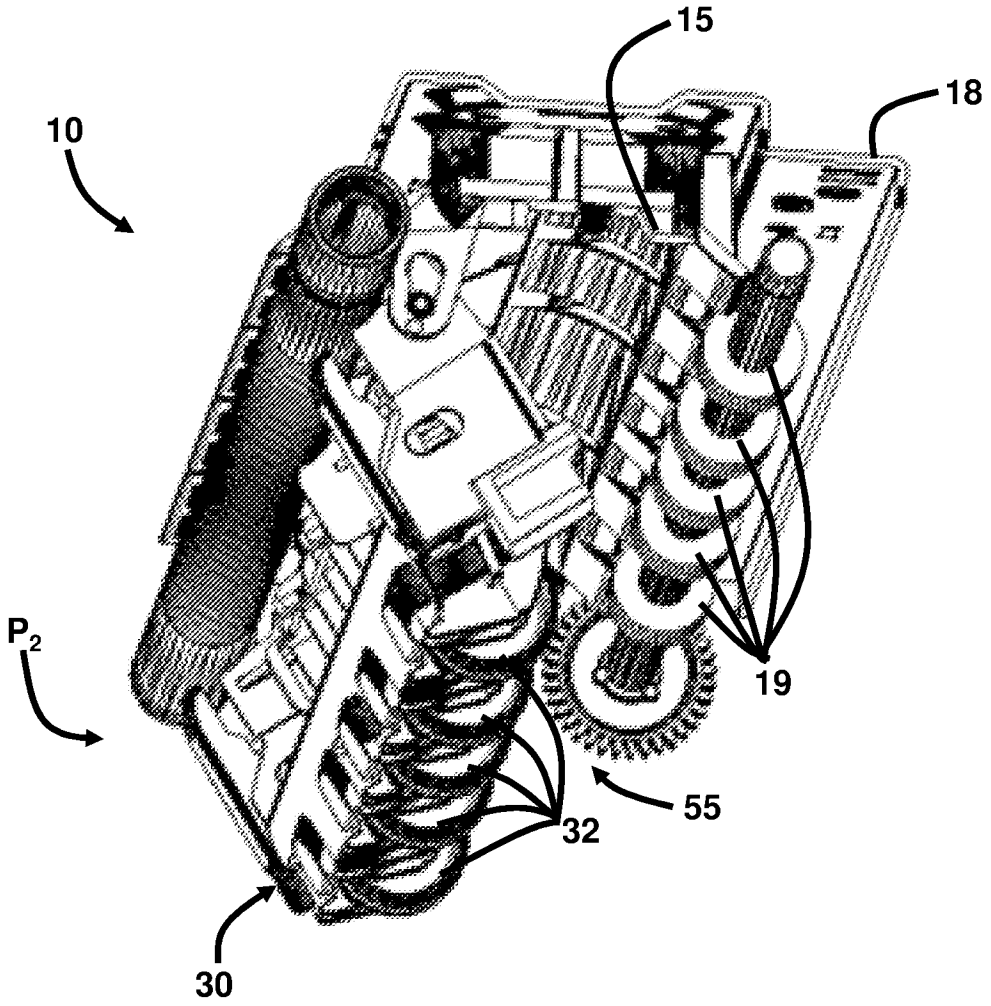
FIG. 9 is another perspective view of the assembly of FIG. 7 rotated into a second position with an open space created to clear a print medium jam, according to an example.

FIG. 9, with reference to FIGS. 1 through 8, illustrates another view of the assembly 10 in the second position $P_2$. In this view, the multiple turn rollers 19 of the first guide 15 and the multiple turn rollers 32 of the second guide 30 are shown. The turn rollers 19, 32 assist in moving the print medium 35 along the pre-print zone print medium path 37 and the print medium 35 may become jammed between the rollers 19, 32. However, when the assembly 10 is in the second position $P_2$ such that the second guide 30 rotates away from the first guide 15 creating the space 55 in between the first guide 15 and the second guide 30, the once jammed print medium 35 may become easily released and can fall below to an area 29, shown in FIG. 4, easily accessible by a user once the support mechanism 60 has been removed; i.e., through the one or more access panels 22 of the imaging device 20.

After a print medium jam is cleared, the support mechanism 60 may be reinserted into its position which engages the assembly 10 by pushing the second guide 30 back into the first position $P_1$, which returns the pre-print zone print medium path 37 back to its closed state and ready for receiving print medium 35 in the assembly 10, and allows the turn rollers 19, 32 to be aligned with one another for receiving print medium 35. The support mechanism 60 may engage the second guide 30 by way of the interface mechanism 45. The assembly 10 allows jammed print media 35 to be released in media paths 37 that are traditionally difficult to physically access by a user of an imaging device 20, which permits the released print media 35 to be easily removed from the imaging device 20 and return the imaging device 20 back to a fully functional state. Because the assembly 10 is passive, it requires no further action for the second guide 30 to rotate into the second position $P_2$ once the support mechanism 60 has been removed, and as such no firmware updates are required for the assembly 10 to function.

Nonetheless, various examples described herein may include both hardware and software elements. The examples that are implemented in software may include firmware, resident software, microcode, etc. Other examples may include a computer program product configured to include a preconfigured set of instructions, which when performed, may result in actions as stated in conjunction with the methods described above. In an example, the preconfigured set of instructions may be stored on a tangible non-transitory computer readable medium or a program storage device containing software code. In the software embodiments, instructions may be provided to the assembly 10 by a processor 65 linked to the assembly 10. The processor 65 may be further linked to the control panel 21 providing operational status updates and information regarding the position $P_1$ or $P_2$ of the assembly 10 as well as the status of any print media jams in the assembly 10.

Figure 10:
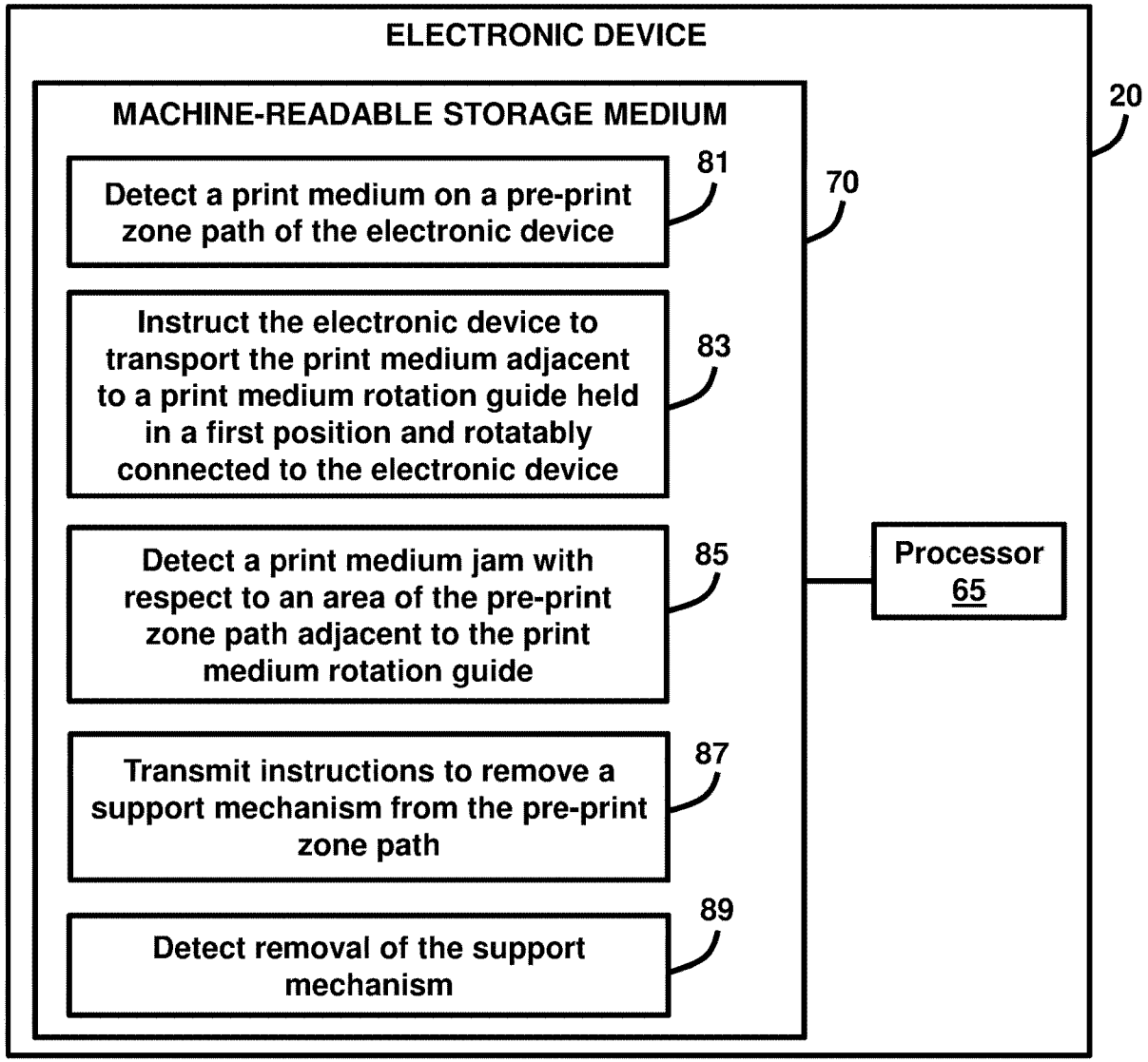
FIG. 10 is a block diagram of an imaging device in which a print medium jam is being cleared, according to an example.

FIG. 10 with reference to FIGS. 1 through 9, is a block diagram of an electronic device; e.g., such as an imaging device 20, comprising the processor 65 as described above and a machine-readable storage medium 70. In an example, the electronic device may contain the imaging device 20 or may be a separate electronic device comprising its own hardware and structural components apart from the imaging device 20. The electronic device may be the imaging device 20 in another example. The electronic device may be used for printing, scanning, copying, faxing, or for other purposes that process print medium 35. Processor 65 may include a central processing unit, microprocessors, and/or other hardware devices suitable for retrieval and execution of instructions stored in a machine-readable storage medium 70. Processor 65 may fetch, decode, and execute computer-executable instructions 81, 83, 85, 87, and 89 to enable execution of locally-hosted or remotely-hosted applications for controlling action of the electronic device; e.g., such as the imaging device 20. The remotely-hosted applications may be accessible on one or more remotely-located devices, for example. As an alternative or in addition to retrieving and executing instructions, processor 65 may include one or more electronic circuits including a number of electronic components for performing the functionality of one or more of instructions 81, 83, 85, 87, and 89.

The machine-readable storage medium 70 may be any electronic, magnetic, optical, or other physical storage device that stores executable instructions. Thus, the machine-readable storage medium 70 may be, for example, Random Access Memory, an Electrically-Erasable Programmable Read-Only Memory, a storage drive, an optical disc, and the like. In one example, the machine-readable storage medium 70 may include a non-transitory computer-readable storage medium. The machine-readable storage medium 70 may be encoded with executable instructions for enabling execution of remotely-hosted applications accessed on the one or more remotely-located devices.

In an example, the processor 65 of the imaging device 20 executes computer readable instructions. For example, computer-executable detecting instructions 81 may detect a print medium 35 on a pre-print zone path 37 of the electronic device such as the imaging device 20. Computer-executable measuring instructions 83 may instruct the electronic device such as the imaging device 20, to transport the print medium 35 adjacent to the print medium rotation guide; e.g., second guide 30 held in the first position $P_1$ and rotatably connected to the electronic device such as the imaging device 20. Computer-executable generating instructions 85 may detect a print medium jam with respect to an area 25 of the pre-print zone path 37 adjacent to the print medium rotation guide; e.g., second guide 30. Computer-executable transmitting instructions 87 may transmit instructions to remove the support mechanism 60 from the pre-print zone path 37. Computer-executable transmitting instructions 89 may detect removal of the support mechanism 60.

In one example, the processor 65 is to detect a releasing of the bias element 50 that retains the print medium rotation guide; e.g., second guide 30 in the first position $P_1$ and the rotation of the print medium rotation guide; e.g., second guide 30 into the second position $P_2$. Moreover, in another example, the processor 65 is to detect a releasing of the print medium 35 from the pre-print zone path 37 upon the print medium rotation guide; e.g., second guide 30 moving back into the first position $P_1$ after the support mechanism 60 has been placed back into position in the electronic device such as the imaging device 20.

The present disclosure has been shown and described with reference to the foregoing exemplary implementations. Although specific examples have been illustrated and described herein it is manifestly intended that the scope of the claimed subject matter be limited only by the following claims and equivalents thereof. It is to be understood, however, that other forms, details, and examples may be made without departing from the spirit and scope of the disclosure that is defined in the following claims.

What is claimed is:

1. An assembly comprising:

a first guide positioned in a pre-print zone area of an imaging device;

a second guide rotatably connected to the imaging device and spaced apart from the first guide to permit a print medium to traverse between the first guide and the second guide;

a bearing mechanism connecting the second guide to the imaging device in the pre-print zone area;

an interface mechanism operatively connected to the second guide; and a bias element positioned between the interface mechanism and the second guide to release energy upon exposing the interface mechanism to the pre-print zone area allowing rotation of the second guide away from the first guide.

2. The assembly of claim 1, wherein the second guide is rotatable due to gravitational effects upon the second guide.

3. The assembly of claim 1, wherein the bias element releases energy upon removal of a support mechanism positioned against the interface mechanism.

4. The assembly of claim 1, wherein the rotation of the second guide away from the first guide creates a space between the first guide and the second guide that releases the print medium from between the first guide and the second guide.

5. The assembly of claim 1, wherein the interface mechanism is rotatably connected to the second guide.

6. A device comprising:

a print medium guide held in a first position in a printer to permit a print medium to traverse along a pre-print zone print medium path;

a first mechanism rotatably connecting the print medium guide to the printer;

a second mechanism operatively connected to the print medium guide; and a spring biasing the second mechanism against the print medium guide to cause the second mechanism to pivot upon release of potential energy stored in the spring allowing rotation of the print medium guide into a second position and creating an open area in the pre-print zone print medium path.

7. The device of claim 6, wherein the first mechanism comprises a pair of hinges.

8. The device of claim 6, wherein the second mechanism comprises a pair of levers.

9. The device of claim 6, wherein the potential energy is released from the spring upon removal of a support mechanism from against the second mechanism.

10. The device of claim 6, comprising a fixed guide connected to the printer, positioned in a pre-print zone area of the printer, and spaced apart from the print medium guide in both the first position and the second position.

11. The device of claim 10, wherein the print medium guide is substantially parallel to the fixed guide in the first position.

12. The device of claim 10, wherein the print medium guide is substantially perpendicular to the fixed guide in the second position.

* * * * *